US006876349B2

(12) United States Patent
Edwards et al.

(10) Patent No.: US 6,876,349 B2
(45) Date of Patent: Apr. 5, 2005

(54) MATRIX DISPLAY DEVICES

(75) Inventors: Martin John Edwards, Crawley (GB); Karel Elbert Kuijk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 345 days.

(21) Appl. No.: 09/947,779

(22) Filed: Sep. 7, 2001

(65) Prior Publication Data

US 2002/0054005 A1 May 9, 2002

(30) Foreign Application Priority Data

Sep. 11, 2000 (EP) ..... 00203130

(51) Int. Cl.[7] ..... G09G 3/36

(52) U.S. Cl. ..... 345/92; 345/87; 345/92; 345/98; 345/100; 345/204

(58) Field of Search ..... 345/87, 92, 98, 345/100, 204, 206

(56) References Cited

U.S. PATENT DOCUMENTS 5,448,258 A * 9/1995 Edwards ..... 345/90
5,852,425 A * 12/1998 Bird et al. ..... 345/92
6,157,358 A * 12/2000 Nakajima et al. ..... 345/96
6,380,917 B2 * 4/2002 Matsueda et al. ..... 345/89
6,552,707 B1 * 4/2003 Fujiyoshi ..... 345/98

FOREIGN PATENT DOCUMENTS

EP 0911677 A1 4/1999 ..... G02F/1/133

* cited by examiner

*Primary Examiner*—Henry N. Tran
*Assistant Examiner*—Peter Prizio, Jr.

(57) ABSTRACT

Digital to analogue conversion in an AMLCD is obtained by using the column electrode capacitance as part of the digital to analogue conversion circuit by dividing columns (19) into separate sections and serially performing the conversion via switching elements (31). Alternative embodiments comprise a column driver circuit with capacitors having a (binary) divided range of capacitance or use column sub-electrodes of different widths.

19 Claims, 5 Drawing Sheets

MATRIX DISPLAY DEVICES

Figure 1:
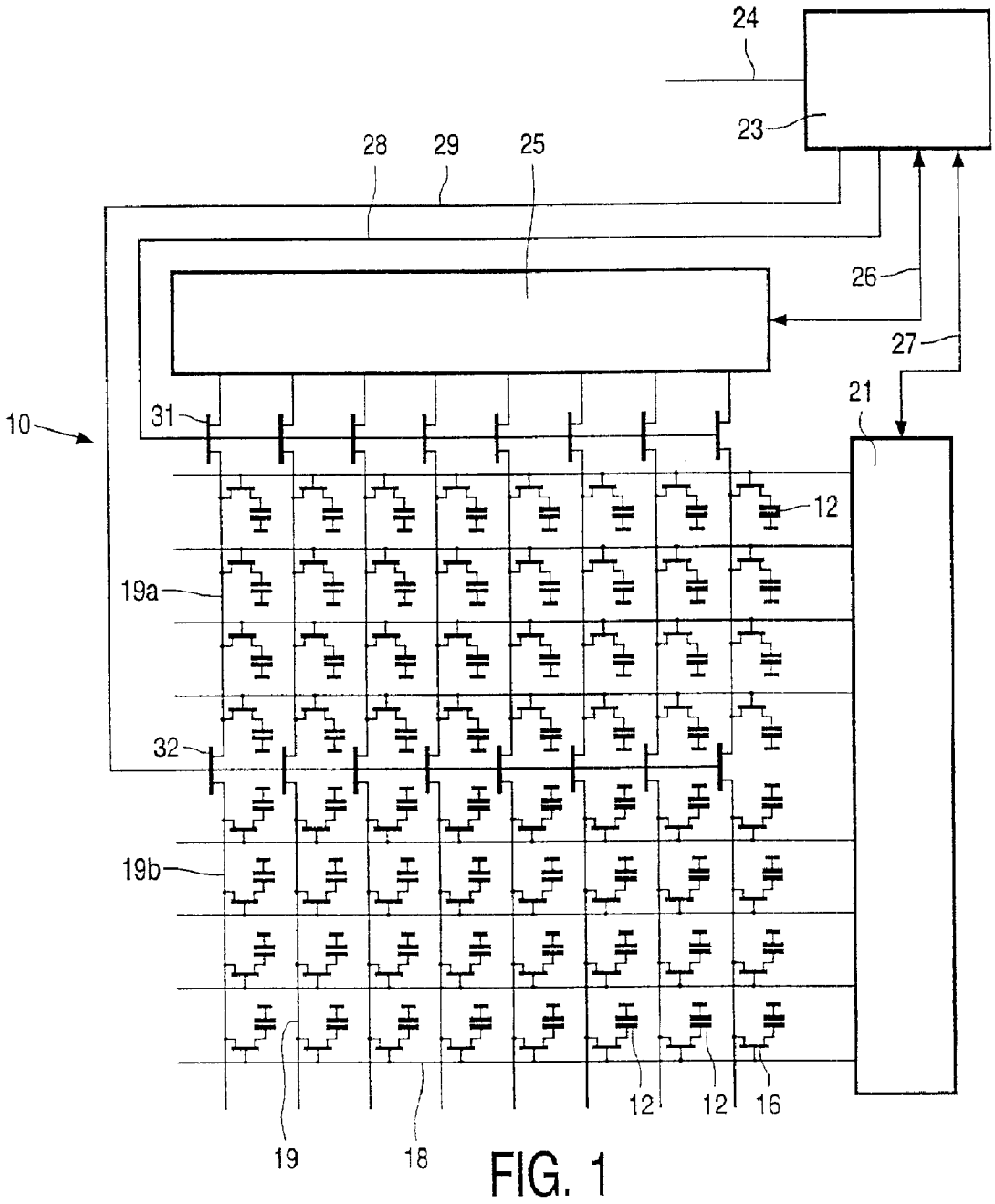

This invention relates to a matrix display device comprising a matrix of picture elements at the crossings of selection electrodes to select rows of picture elements and column electrodes to provide data, further comprising drive means via which selection signals and data signals are applied to the picture elements, the matrix display device comprising charge redistribution digital to analogue converter means for converting a multi-bit digital data signal, the digital to analogue converter means comprising at least one conversion switch.

A matrix display device of the above kind, and more particularly a liquid matrix display is described in U.S. Pat. No. 5,448,258 whose contents are incorporated herein by reference. The display device has a number of advantages over conventional kinds of matrix display devices in which data signals supplied by a column drive circuit via the column address conductors to the picture elements comprise analogue voltage signals, especially when the video signal supplied to the display is a digital signal. The need to convert the digital picture information signals to analogue (amplitude modulated) signals before applying to the column address conductors is removed. The column drive circuit can readily be implemented using purely digital circuitry thereby making it capable of operating at comparatively high speeds and of being conveniently integrated on a substrate of the display panel using thin film transistors, TFTs. The switching transistors of the picture elements comprise TFTs of one conductivity type and can be of the same kind as those used in the drive circuit and fabricated simultaneously therewith.

The charge redistribution digital to analogue conversion is performed in a serial way using capacitor elements of a picture element, which in one embodiment are constituted by sub-elements obtained by dividing a display element into two discrete parts. The charge redistribution elements are operated in picture element address periods by turning on a first of two TFTs, by means of a switching signal, so as to charge a first of the capacitor elements according to the first bit of a serial multi-bit data signal then present on the associated column conductor. The TFT is turned off by, by removing the switching signal, and the second TFT turned on, by means of a further switching signal, so that the charge on the one capacitor element is shared between the two capacitor elements. This TFT is then turned off and the first TFT turned on again so as to charge the one capacitor element according to the second bit of the serial multi-bit data signal then on the column conductor, following which the first TFT is turned off and the second TFT turned on so as to allow again charge sharing between the two capacitor elements. The cycle is repeated for all bits such that, after the final operation of the second TFT a voltage level is obtained on the capacitor elements according to the multi-bit data signal. The TFTs (switches) are used both for selection and for bringing about the digital to analogue conversion. However provision of the capacitors reduces the aperture. This also holds if these capacitors are obtained by dividing a display element into two sub-elements, since two TFTs per picture element are always needed.

It is an object of the present invention to provide an improved matrix display device of the kind described in the opening paragraph.

It is another object of the present invention to provide an improved matrix display device of the kind described in the opening paragraph in which the aforementioned limitations, and the problems caused thereby, can be overcome at least to some extent.

According to the present invention, a matrix display device of the kind described in the opening paragraph is characterised in that the digital to analogue conversion of said digital to analogue converter means at least comprises the column electrode capacitance. The column electrode capacitance may be used in several ways. It may for instance be broken down into sub-electrodes to obtain digital to analogue conversion based on the areas occupied by said sub-electrodes. On the other hand serial charge redistribution may be introduced.

The invention provides a number of advantages. The number of row address conductors required, one per row of picture elements, remains the same. The number of TFTs per display element is reduced by almost 50%, since instead of two TFTs per picture element one TFT is enough at the cost of some TFTs for each column electrode (two or more, dependent on the kind of digital to analogue conversion) leading to larger aperture. Since the digital to analogue conversion no longer depends on dedicated capacitors or the capacitances of divided display elements, larger freedom of design is obtained.

A further, and important, advantage of the invention is that it overcomes an operational limitation found with the display device of U.S. Pat. No. 5,448,258. Because in this known device each row of picture elements is operated by two row address conductors and each row address conductor is used by two adjacent rows of picture elements, the vertical scan direction cannot be reversed without corrupting the intended display when the capacitor elements both comprise display sub-elements. If the array of picture elements was to be driven from bottom to top rather than from top to bottom then the input TFT of the conversion circuit of a picture element in one row would be turned on after the conversion process for that row had been completed when the picture elements in the above row are addressed, thereby causing the stored voltage to be altered. In the display device of the invention, on the other hand, each row of picture elements is driven via a respective row address conductor and the vertical scan direction can readily be reversed. This capability can be useful in a number of applications. For example, projection display systems using a matrix display device are known which are designed so that they can either be floor mounted or ceiling mounted in an inverted orientation. As the vertical scan can readily be reversed, the display device is suitable for use in such an application. A similar requirement is found in car navigation systems, where the display may need to be mounted above or below the dashboard.

In a preferred embodiment each column electrode comprises at least two sub-electrodes, the sub-electrodes being interconnectable by the conversion switches. Each column electrode for instance is divided in a number of parts mutually interconnected by the conversion switches, each part having its own capacitance value (e.g. in a ratio 4:2:1). A certain amount of charge, representing a grey value is introduced by sequentially providing binary data to one end of the column electrode while the other end has a fixed voltage value. The actual grey value depends on the number of data bits and the number of mutually interconnected electrode parts. After the charge redistribution digital to analogue conversion is performed in a serial way using capacitor elements of the column electrode, a row electrode is activated to transfer the corresponding grey value to the picture element.

In a further embodiment based on serial digital to analogue conversion at least two column electrodes are interconnectable by conversion switches while separate sub-row electrodes select the picture elements related to each column electrode.

In another embodiment, which is now based on parallel digital to analogue conversion the digital to analogue conversion of said digital to analogue converter means is determined by the number of conversion switches being activated during selection of the row. The digital to analogue converter means comprise several capacitors which are interconnectable by the conversion switches to a common point. A selection switch is then present between said common point and the column electrode while a further switch element connects said common point to a reference voltage. The ratio of the capacitors defines the digital to analogue conversion.

Column sub-electrodes of different width on the other hand may determine said digital to analogue conversion. Conversion switches are now present between each sub-electrode and the common point while a further switch element connects said common point to a reference voltage again.

Figure 2:
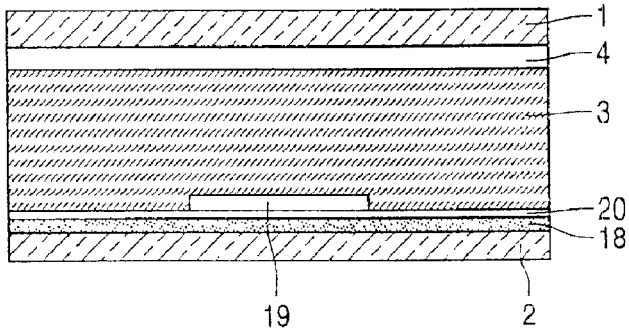
Figure 3:
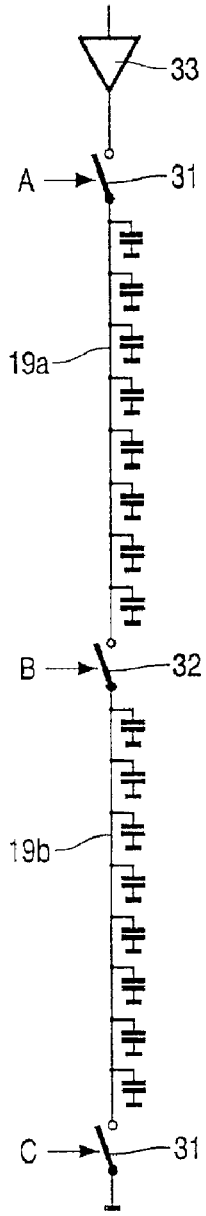
Figure 4:
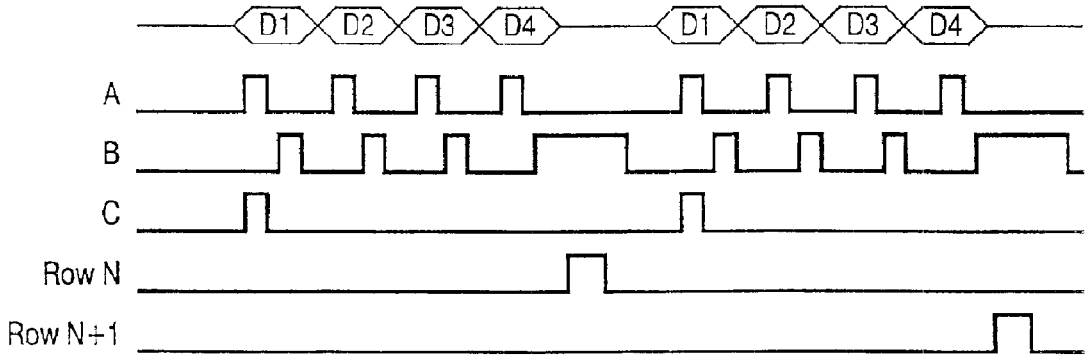
Figure 5:
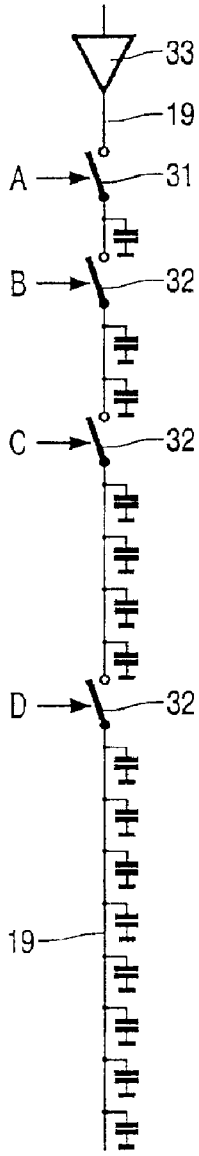
Figure 6:
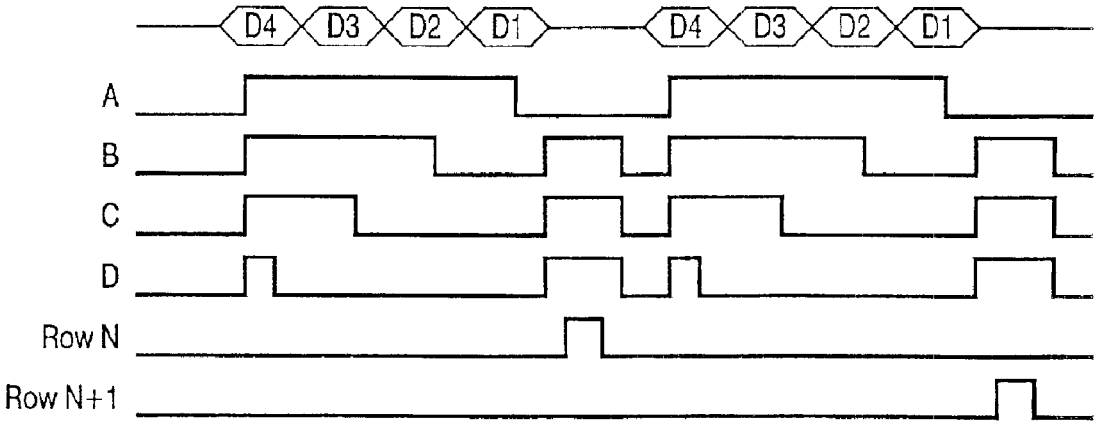
Figure 7:
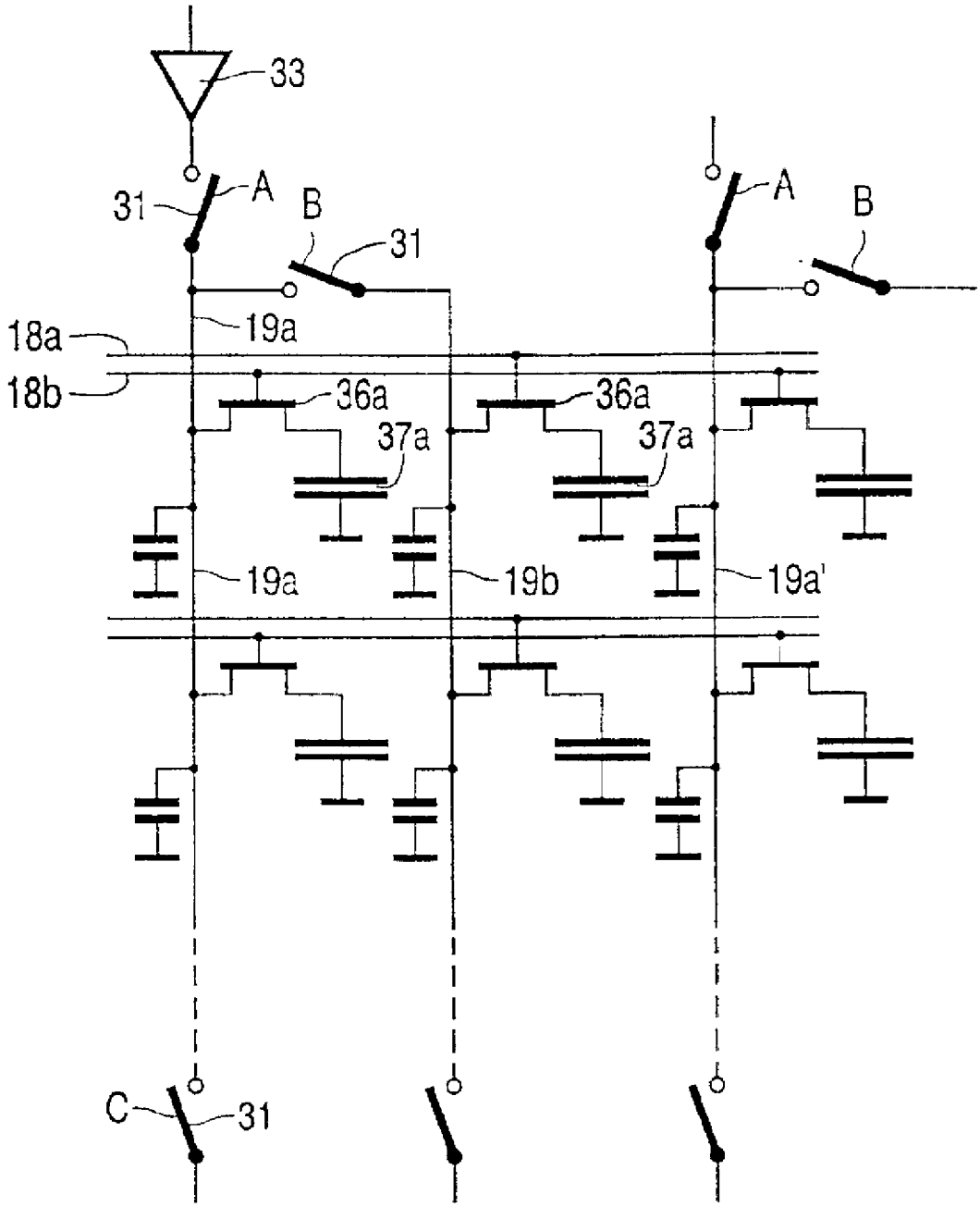
Figure 8:
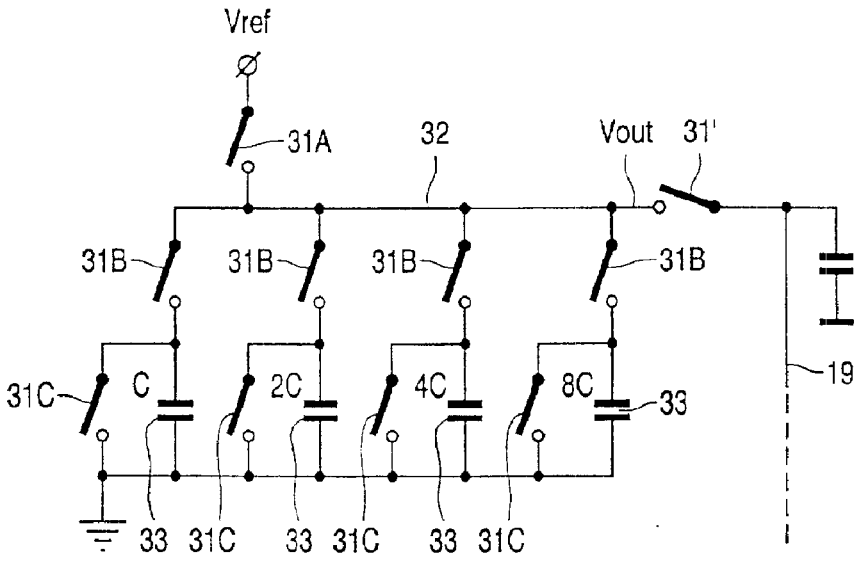
Figure 9:
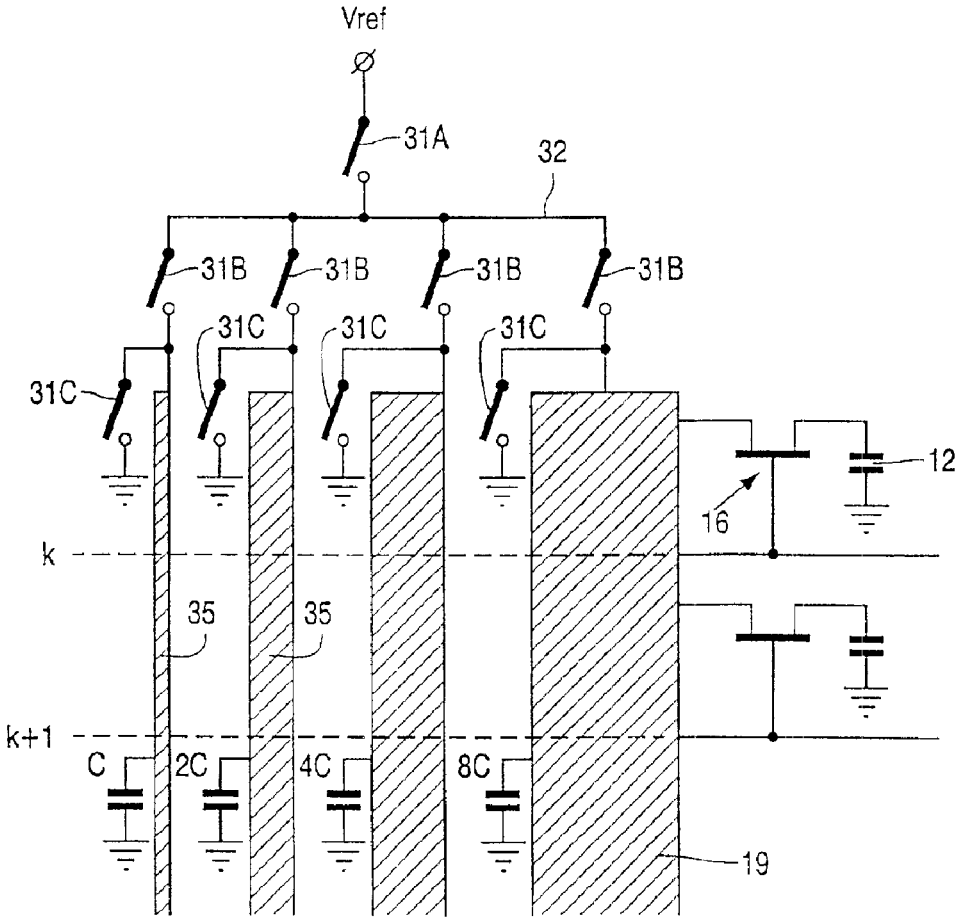

Embodiments of matrix display devices in accordance with the present invention will now be described by way of example, with reference to the accompanying drawings, in which:

FIG. 1 is a schematic block diagram of an embodiment of a matrix display device according to the invention, FIG. 2 is a schematic cross-section of a part of the matrix display device, FIG. 3 shows schematically a circuit configuration of a single column in a device according to the invention, FIG. 4 illustrates example waveforms applied to row and column address conductors and conversion switches of the display, FIG. 5 shows schematically another circuit configuration of a single column in a device according to the invention, FIG. 6 illustrates example waveforms applied to row and column address conductors and conversion switches of the display of FIG. 5, while FIGS. 7, 8 and 9 describe further embodiments of the invention.

Referring to FIG. 1, the matrix display device comprises a liquid crystal display device having a row and column array of picture elements 12 formed in a display panel 10. The picture elements 12 include liquid crystal display elements formed by spaced electrodes carried respectively on the opposing surfaces of first and second (glass) substrates (1, 2) with twisted nematic liquid crystal material 3 therebetween (see FIG. 2). The picture element electrodes on the first substrate comprise respective portions of a electrode layer 4 common to all display elements in the array while the other electrodes of the display elements comprise individual electrode layers (not shown in FIG. 2) carried on the second substrate 2 together with their addressing circuitry. The picture elements 12 include switching TFTs 16 which are connected to sets of row conductors 18 (1 to r) and column conductors 19 (1 to c) carried on the second substrate to which drive signals for driving the picture elements are supplied from a peripheral drive circuit comprising a row drive circuit 21 and a column drive circuit 25 both of which comprise digital circuitry and are integrated on the display panel 10. The row drive circuit is operable to scan the rows of picture elements in turn in each field via the row conductors by applying switching waveform signals to the row conductors, which operation is repeated for successive fields, and is controlled by timing signals provided from a timing and control circuit 23 to which an input signal 24 is supplied. The input signal can be either analogue or digital video (picture) data, e.g. a TV signal or a computer video signal. Control and data signals are exchanged between the control circuit 23 and the row drive circuit 21 and column drive circuit 25 along buses 26, 27, while further control lines 28, 29 control transfer gates (conversion switches) 31, realised as TFT transistors 31. The column drive circuit is supplied with digital video data (via an AD converter if analogue input is used) and operates to apply to the set of column conductors 19, appropriately in parallel for the respective picture elements in a row, and in synchronism with scanning of the rows, data signals in a serial multi-bit digital form. The digital signal supplied to the column drive circuit 25 is demultiplexed and samples from a complete line of (video) information are stored in latch circuits of the circuit 25 as appropriate to their associated column of picture elements. As in conventional displays the writing of the (video) information to the picture elements takes place on a row by row basis in which a line of video information is sampled by the column drive circuit 25 and subsequently written to the picture elements 12 in a selected row via the column conductors, the identity of the selected row being determined by the row drive circuit 21. Unlike conventional displays, however, the video information supplied by the column drive circuit to a column conductor for a display element is in a serial multi-bit digital form rather than analogue (amplitude modulated) form.

The column conductors have a capacitance, which is distributed along the length of said column conductors (column electrodes 19). Each column capacitance comprises the capacitance between the column electrode and other electrodes within the display. FIG. 2 illustrates schematically a cross-section through the matrix display at the point where one of the column electrodes 19 crosses over a row conductor or row electrode 18. The column capacitance may include the capacitance between the column electrode and the row electrodes, the two being separated by a dielectric layer 20, the capacitance between the column electrode and the common electrode 4 of the display, in which case the liquid layer 3 forms the dielectric layer, the source-gate capacitance of the sources of the thin film transistors and the capacitance between the column electrode and picture electrodes. Since the active matrix display has a regular structure the column capacitance is distributed uniformly along the column electrode.

According to a first embodiment of the invention the column electrode 19 comprises (in this example two) sub-electrodes 19*a*, 19*b*, which sub-electrodes are interconnectable by the conversion switch (thin film transistor) 32, see FIG. 3.

Each column electrode is divided into two parts in this example, which parts have substantially equal length and consequently can be represented by substantially equal capacitors. Further conversion switching devices 31 are provided at both ends of the column electrode. One of the switching devices is provided to allow transfer of the digital data from the column drive circuit 25 (shown schematically by an output amplifier 33 in FIG. 3) to the upper half of the column electrode. The other switching device 31 allows the lower half of the column electrode to be connected to a predetermined potential. The conversion process is controlled by the three conversion switch signals A, B, C, the sequence of addressing signals for addressing two pixels within a column being illustrated in FIG. 4. It is assumed that the switching devices are n-type TFTs which are turned on when the switching signals applied to the gate terminals of the devices are in a high state. Alternatively p-type transistors or CMOS transmission gates could be used. The control signals usually, but not necessarily, are common to all columns in a display Addressing, as shown in FIG. 4, begins with the column drive circuit 25 applying a voltage to the column electrode, representing the state of the least significant bit of the digital data to be converted, while simultaneously conversion switching devices 31 (A, C) go to a high state in order to turn on the corresponding TFTs. A charge corresponding to the least significant bit of the digital data is transferred to the upper half of the column electrode and the lower half of the column electrode is charged to a predetermined voltage, e.g. earth potential, in order to reset said lower half of the column electrode. The TFTs controlled by signals A, C are then turned off and the TFT controlled by signal B is turned on. Charge sharing takes place between the two halves of the column capacitance and the voltages on the capacitors equalise. The control signal B then returns to the low level, turning off its associated transistor, a voltage representing the next bit of the digital data is generated at the output amplifier 33 of the column drive circuit 25 and the control signal A goes high to allow this second bit to be transferred to the upper half of the column electrode. The control signal A then returns to the low level and the control signal B goes high allowing charge sharing to take place between the two components of the column capacitance. This process is repeated for each bit of the digital data in turn, in this case a four bit conversion. The final charge sharing is completed when signal B goes high for the last time in the conversion, resulting in the converted voltage being present on both halves of the column electrode. At this point the appropriate row electrode can be taken to the select voltage level in order to transfer this converted voltage to the display element via the TFT 16.

FIG. 5 shows another method for dividing the column electrode 19 to form capacitors for use in a D/A converter, the division resulting in a set op capacitors with binary weighted values. Although the lengths of the column electrode sections have been shown as increasing moving down the column electrode it is not necessary for them to be in this particular order as long as the ordering of the bits of data supplied by the column drive circuit is consistent with the ordering of the column sections. In this example four separate capacitors are formed to provide a four bit data conversion. Conversion switching devices 32 are located between portions of the column electrode with an additional conversion switching device 31 connected between the column electrode and the output amplifier 33 of the column drive circuit (the conversion switching devices are here again of n-type TFTs).

To perform a data conversion all of the control signals are initially high so that all of the switches are closed. A voltage representing the most significant bit of the digital data is applied to the column electrode by the column drive circuit and this is transferred to the lowest section of the column electrode. The switch controlled by signal D is then opened and a voltage representing the next significant bit of the digital data is applied to the upper part of the column electrode by the column drive circuit. The switch controlled by signal C is then opened and a voltage representing the next significant bit of the digital data is applied to the remaining section of the column electrode. This process is repeated until all of the sections of the column electrode have been charged to voltage levels corresponding to the state of their respective bits in the digital data. At this point the transistors controlled by signals B, C and D are turned on and charge sharing takes place between the sections of the column electrode resulting in the required converted voltage on all sections. The appropriate row electrode in the display can then be selected and the converted voltage transferred to the display elements.

In the example of FIG. 7 two (or if necessary more) columns are supported with voltages representing bits of the digital data via a single output amplifier 33. Column electrodes have substantially equal length and consequently can be represented by substantially equal capacitors. Conversion switching devices 31 (A, C) are provided at both ends of the column electrode. One of the switching devices (31A) is provided to allow transfer of the digital data from the column drive circuit 25 (shown schematically by the output amplifier 33 in FIG. 7) to one of the column electrodes. The other switching device 31C allows the lower half of the column electrode to be connected to a predetermined potential. The conversion process is controlled by a further conversion switching device 31B and may be described in a similar way as the process described with respect to the embodiment of FIGS., 3, 4, the switches C for the two columns being switched simultaneously. Now, however, when the final charge sharing is completed, this results in the converted voltage being present on one of the column electrodes only. An appropriate sub-row electrode 18*a* in the display can then be selected and the converted voltage transferred to (in this example) half of the display elements in the row. For the other half of the pixels in the row the conversion process is repeated after which sub-row electrode 18*b* in the display is selected and the converted voltage transferred to the other half of the display elements in the row.

FIG. 8 shows how charge sharing is obtained by using a column electrode and part of a column driver circuit. The conversion circuit comprises four capacitors interconnected via the conversion switches 31B to a common node 32, each part having its own capacitance value (e.g. in a ratio 8C:4C:2C:1C). The capacitors are first discharged (in this case in parallel although serially operating the switches is possible too) by closing the switches 31C. A certain amount of charge, representing a grey value is introduced by providing binary data, which determine the state of the conversion switches 31B (ON or OFF). The actual grey value depends on the number of data bits and the number of conversion switches 31B being ON, which determines the voltage on node 32 (between zero and $V_{ref}$) and the capacitance ratio of C and the column voltage. After the capacitances 33 have been charged, by closing switch 31A the digital to analogue conversion is finalised by charge redistribution between the capacitors 33 and capacitor elements of the column electrode, by closing switches 31B, while switches 31A, 31C are open. Then a row electrode is activated to transfer the corresponding grey value to the picture element (not shown). The voltage $V_{out}$ at node 32 is reduced by a factor $15C/(15C+C_{col})$, $C_{col}$ being the column capacitance. Since $V_{col}$ does not vary much over the area of a displace this can be considered a constant voltage reduction, which can be incorporated, while choosing the value of $V_{ref}$.

In stead of using capacitors interconnected via conversion switches the column capacitances of column sub-electrodes 19 are used in the embodiment of FIG. 9, the column subelectrodes having a binary width ratio 8w:4w:2w:w. The sub-electrodes now act as capacitors in a similar way as described with reference to the capacitors 33 in FIG. 8. Incoming 4-bit data closes or opens switches 31B, 31C to charge or not charge the column capacitances to a value corresponding to the bit values. Then again the digital to analogue conversion is finalised by charge redistribution between the column subelectrodes 19, by closing switches 31B, while switches 31A, 31C are open. In this example there is no voltage reduction at node 32, so the extra switch 31' (FIG. 8) can be dispensed with. While the digital to analogue conversion is finalised by charge redistribution between the column sub-electrodes, by closing switches 31B, while switches 31A, 31C are open, TFT switch 16 may be open to transfer the voltage value to picture element 12. This embodiment is extremely suitable for reflective display devices where extra space for the subelectrodes 19 is present, since they are generally covered by the picture electrodes.

Other modifications will be apparent to persons skilled in the art. For example, the switches 31C in the embodiment of FIGS. 3, 4 can be eliminated if the column drive circuit outputs the reset voltage before data conversion begins and the remaining two switches 31(A, B) are turned on simultaneously in order to reset the conversion circuit.

What is claimed is:

1. A matrix display device comprising:

a matrix of picture elements at crossings of selection electrodes that select rows of picture elements, and column electrodes that provide date, a row driver that is configured to provide selection signals to the selection electrodes, a column driver that is configured to provide data signals to the column electrodes, and a charge redistribution digital to analog converter that is configured to convert a multi-bit digital data signal into an analog signal on at least one of the column electrodes, wherein the digital to analog converter includes a capacitance of one or more column electrodes, and the digital to analog converter is configured to apply a binary voltage signal corresponding to each bit of the multi-bit digital data signal to at least a sub-electrode of the one or more column electrodes, the sub-electrode of the one or more column electrodes forming at least one of the crossings of selection electrodes and column electrodes.

2. A matrix display device according to claim 1, wherein each column electrode comprises at least two sub-electrodes, the sub-electrodes being interconnectable by one or more conversion switches in the digital to analog converter.

3. A matrix display device according to claim 2, wherein the column driver is configured to provide:

before selection of a row, binary data to column electrodes and after supplying the binary data, activating associated conversion switches.

4. A matrix display device according to claim 2, wherein the digital to analog converter is configured to convert each bit of the multi-bit digital data signal based on a number of conversion switches being activated during selection of the row.

5. A matrix display device according to claim 4, wherein each sub-electrode is a different width, each sub-electrode being interconnectable by the conversion switches to a common point said common point being interconnectable via a further switch to a reference voltage.

6. A matrix display device according to claim 5, wherein the column driver is configured to provide:

during selection, binary data to the conversion switches and after supplying the binary data, activating the further switch, the display device further comprising means for discharging the digital to analogue convert.

7. A matrix display device according to claim 1, wherein for picture elements within a row, at least two column electrodes are interconnectable by conversion switches, the picture elements related to each column electrode being selected by separate sub-row electrodes.

8. A matrix display device according to claim 7, wherein the display device comprises means for providing, during selection of a single row of picture elements, in an alternating way, binary data to a selection switch during selection at a sub-row, and means for providing, between selection of different sub-rows, redistribution signals to the conversion switches.

9. A matrix display device comprising:

a plurality of column electrodes, a plurality of row electrodes, an array of pixels, each pixel being controlled by an intersection of a column electrode of the plurality of column electrodes end a row electrode of the plurality of row electrodes, at least one column driver that is configured to provide binary voltage values to one or more column electrodes, the binary voltage values corresponding to each bit of a multi-bit data signal, a plurality of switches that are configured to convert the binary voltage values on the one or more column electrodes to art analog voltage on the one or more column electrodes, the analog voltage corresponding to the multi-bit data signal.

10. A matrix display device as claim 9, wherein the plurality of switches are configured to store a charge corresponding to each voltage of the binary voltage values on each sub-electrode of a plurality of sub-electrodes of the one or more column electrodes, and redistribute the charge on the one or more column electrodes to accumulate the analog voltage corresponding to the multi-bit data signal, wherein each sub-electrode forms at least one intersection with at least one row electrode for controlling at least one pixel of the array of pixels.

11. The matrix display device as claim 10, wherein each sub-electrode of the one or more column electrodes has a capacitance value corresponding to a binary weight associated with each corresponding bit of the multi-bit data signal.

12. The matrix display device as claim 11, wherein each sub-electrode corresponds to a single column electrode of the one or more column electrodes.

13. The matrix display device as claim 11, wherein each of the plurality of sub-electrodes has a substantially equal capacitance.

14. The matrix display device as claim 9, wherein the at least one column driver provides the binary voltage values to the one or more column electrodes sequentially.

15. A method of providing an analog voltage to a column electrode that controls a pixel at an intersection with a row electrode, comprising:

receiving a multi-bit data value, applying a binary signal value corresponding to each bit of the multi-bit data value to at least a sub-electrode of the column electrode to provide a charge on at least the sub-electrode of the column electrode corresponding to each bit, selectively redistributing the charge on the column electrode, so that an accumulated charge on the column electrode corresponds to the multi-bit data value, and providing the accumulated charge as the analog voltage that controls the pixel.

16. The method of claim 15, wherein selectively redistributing the charge includes:

partitioning one or more of a plurality of column electrodes that includes the column electrode into a first segment that stores a current charge corresponding to the applied binary signal value and at least one second segment that stores an other charge corresponding to one or more other applied binary signal values, and coupling the first segment with the at least one second segment to combine the current charge with the other charge.

17. The method of claim 16, wherein partitioning the one or more column electrodes is dependent upon a binary weight associated with each bit of the multi-bit data value.

18. The method of claim 16, wherein partitioning the one or more column electrodes includes forming the first segment having a capacitance that substantially equals a capacitance of the second segment.

19. The method of claim 16, wherein partitioning the one or more column electrodes includes selecting a first column electrode as the first segment and a second column electrode as the second segment.

* * * * *